US008419209B2

(12) United States Patent
Mai

(10) Patent No.: US 8,419,209 B2
(45) Date of Patent: Apr. 16, 2013

(54) LAMP SUPPORT STRUCTURE FOR LAMP TUBES

(76) Inventor: Mao-Kai Mai, Yangmei (TW)

( * ) Notice: Subject to any disclaimer, the term of this patent is extended or adjusted under 35 U.S.C. 154(b) by 180 days.

(21) Appl. No.: 12/904,257

(22) Filed: Oct. 14, 2010

(65) Prior Publication Data

US 2011/0170285 A1 Jul. 14, 2011

(30) Foreign Application Priority Data

Jan. 14, 2010 (TW) ..... 99200786 U

(51) Int. Cl.
*F21V 21/00* (2006.01)

(52) U.S. Cl.
USPC ..... 362/217.14; 362/468

(58) Field of Classification Search ..... 362/145–148, 362/150, 152, 153, 153.1, 217.01, 219, 225, 362/217.1, 217.11–217.17, 238, 648, 249.01, 362/249.06, 249.11, 370, 396, 404, 426, 362/436, 438, 439, 457, 458, 224, 217.04, 362/217.05, 217.07; 348/49, 50, 58, 62, 348/63, 72, 74.1, 229.15, 229.25, 316.1, 348/316.7; 248/49, 50, 58, 62, 63, 72, 74.1, 248/229.15, 229.25, 316.1, 316.7
See application file for complete search history.

(56) References Cited

U.S. PATENT DOCUMENTS

| | | | | |
|---|---|---|---|---|
| 1,775,768 | A * | 9/1930 | Kenerson | 362/147 |
| 2,469,607 | A * | 5/1949 | Noel et al. | 362/12 |
| 2,753,445 | A * | 7/1956 | Bixby et al. | 362/404 |
| 4,858,087 | A * | 8/1989 | Hartshorn | 362/219 |
| 5,765,939 | A * | 6/1998 | Tanner, Jr. | 362/219 |
| 6,609,813 | B1 * | 8/2003 | Showers et al. | 362/240 |
| 7,014,332 | B2 * | 3/2006 | Sergio et al. | 362/147 |
| 7,213,941 | B2 * | 5/2007 | Sloan et al. | 362/246 |
| 7,307,391 | B2 * | 12/2007 | Shan | 315/291 |
| 2005/0077446 | A1 * | 4/2005 | Bacon et al. | 248/343 |

* cited by examiner

*Primary Examiner* — Hargobind S Sawhney
(74) *Attorney, Agent, or Firm* — Jackson IPG PLLC

(57) ABSTRACT

A lamp support of the present invention comprises a keel as the main body, two arc-shaped extensions provided on two sides of the keel, inwardly protruding lips correspondingly provided on bottom edges of the arc-shaped extensions, and first and second slots provided on the ridge of the keel and arranged perpendicular to each other. The first and second slots can allow for the passage of screws so that the screws can be used to secure the entire lamp support to an assembly main body such as a ceiling or a wall; and the lips correspondingly fit into grooves on both sides of a lamp tube whereby the lamp tube is pushed into a predetermined position to secure the lamp tube to the assembly main body such as a ceiling or a wall.

7 Claims, 6 Drawing Sheets

LAMP SUPPORT STRUCTURE FOR LAMP TUBES

FIELD OF THE INVENTION

The present invention relates to a lamp tube mounting structure, and more particularly to an improvement in lamp support structures capable of increasing the convenience and applicability in mounting lamp tubes.

BACKGROUND OF THE INVENTION

Nowadays, direct lighting fixtures are principally used as general room illumination sources. For example, fluorescent tubes are mounted on a ceiling and light emitted from the fluorescent tubes directly illuminates downwards. In modern society, with continuing technological progress, the technology of lighting systems is developing rapidly. Besides, as the global energy issue becomes increasingly stressed and all the governments in the world will gradually forbid the use of incandescent bulbs in the future, light-emitting diodes (LEDs), relying on the advantages of high efficiency, energy saving and light modulation property, have gradually dominated the lighting market. Their applications in street lamps, vehicle lamps, outdoor lighting, situational lighting, and the like have become the focus of world attention.

Generally, a tube-shaped lighting fixture using LEDs as light-emitting elements is selected and used, which mainly comprises a lamp tube for carrying light-emitting elements and is secured by means of a lamp base to an assembly main body such as a ceiling or a wall. Such conventional lighting fixtures are mostly screwed and secured by screws in a manner that the entire lamp base is directly secured to an assembly main body. By this way, the troubles in the installation and construction may be reduced.

However, the screws must be completely removed in order to repair or replace the lighting fixture in the future. The structural strength of the threaded holes on the assembly main body will be relatively weakened particularly after multiple and repeated disassembly and assembly, so that the threaded holes cannot provide the original grasping force, which is more likely to cause danger when the lighting fixture accidentally drops down.

SUMMARY OF THE INVENTION

In view of the above-described circumstances, it is a primary object of the present invention to provide a lamp support structure convenient for the user to repair or replace lamp tubes.

To achieve the foregoing object, a lamp support of the present invention comprises a keel having a predetermined length as the main body, two arc-shaped extensions provided on two sides of the keel, inwardly protruding lips correspondingly provided on bottom edges of the arc-shaped extensions, and first and second slots provided on the ridge of the keel and arranged perpendicular to each other. The first and second slots can allow for the passage of screws so that the screws can be used to secure the entire lamp support to an assembly main body such as a ceiling or a wall; and the lips correspondingly fit into grooves on both sides of a lamp tube whereby the lamp tube is pushed into a predetermined position to achieve the purpose of securing the lamp tube to the assembly main body such as a ceiling or a wall.

In the present invention, a disk may be further provided, and at least third and fourth slots and fifth and sixth slots are provided on the disk corresponding to the first and second slots; wherein the third slot and the fourth slot are located on the same first center line and arranged perpendicular to each other, and the fifth slot and the sixth slot are located on the same second center line and arranged perpendicular to each other; the third and fourth slots (or the fifth and sixth slots) can be optionally used to screw and secure the disk to an assembly main body such as a ceiling or a wall, and then the fifth and sixth slots (or the third and fourth slots) are used to secure the lamp support to the lower portion of the disk so as to achieve the purpose of facilitating the adjustment of the assembly angle of the lamp tube.

DETAILED DESCRIPTION OF THE PREFERRED EMBODIMENTS

Figure 1:
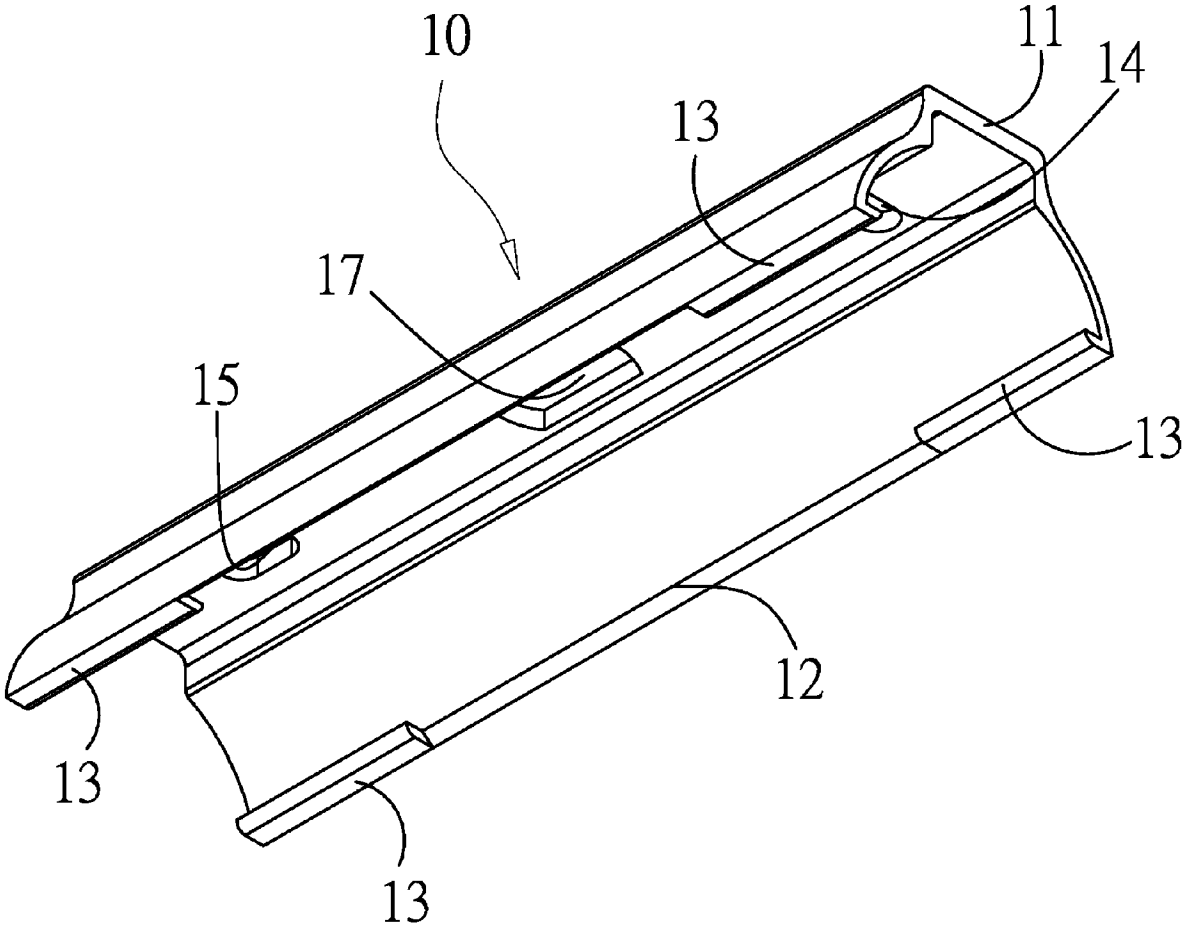
FIG. 1 is a three-dimensional view of the appearance of a lamp support according to the present invention.

The present invention aims to provide a lamp support structure capable of increasing the convenience and applicability in mounting lamp tubes. As illustrated in FIG. 1, a lamp support 10 of the present invention comprises a keel 11 having a predetermined length as the main body, two arc-shaped extensions 12 provided on two sides of the keel, at least one pair of inwardly protruding lips 13 correspondingly provided on bottom edges of the arc-shaped extensions 12, and a first slot 14 and a second slot 15 provided on the ridge of the keel 11 and arranged perpendicular to each other.

Figure 2:
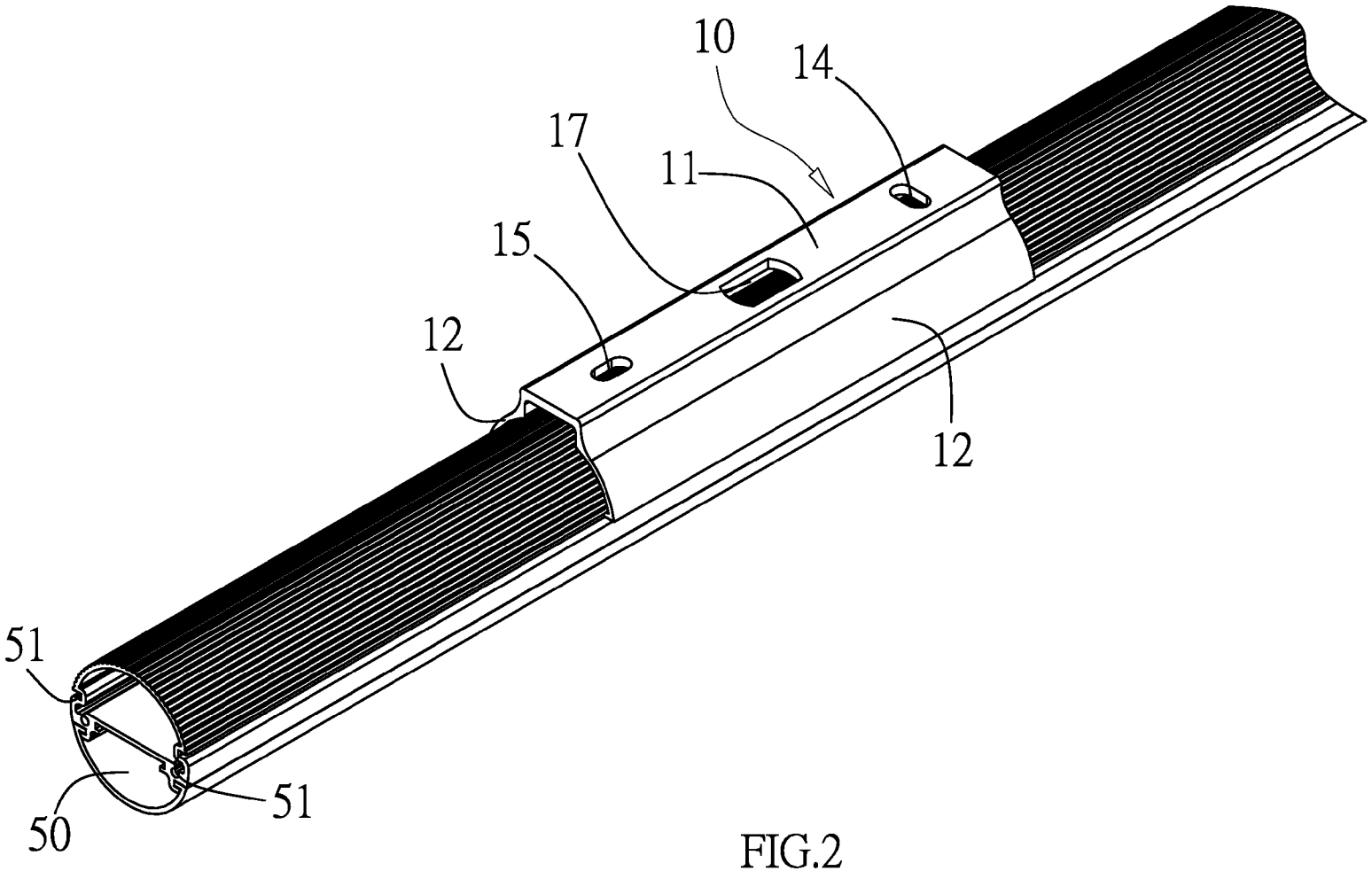
FIG. 2 is an appearance view of the assembly of a lamp support with a lamp tube according to the present invention.
Figure 3:
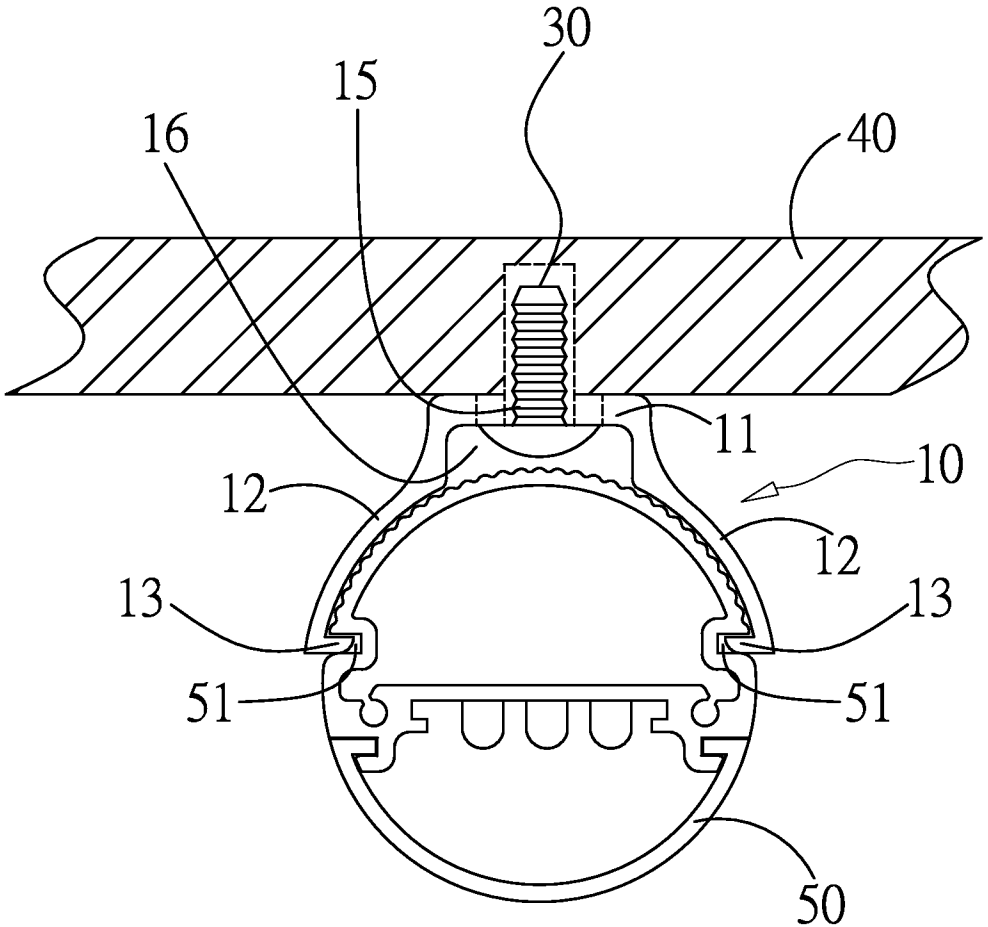
FIG. 3 is a cross-sectional view of the installation of a lamp support and a lamp tube according to the present invention.

As illustrated in FIGS. 2 and 3, when the lamp support 10 of the present invention is in use, The first and second slots 14, 15 can allow for the passage of screws 30 so that the screws 30 can be used to secure the entire lamp support 10 to an assembly main body 40 such as a ceiling or a wall; and the lips 13 correspondingly fit into grooves 51 on both sides of a lamp tube 50 whereby the lamp tube 50 is pushed into a predetermined position to achieve the purpose of securing the lamp tube 50 to the assembly main body 40 such as a ceiling or a wall.

Furthermore, there is a cross sectional difference between the roots of the two arc-shaped extensions 12 of the lamp support 10 and the ridge of the keel 11 of the lamp support 10, so that a heat dissipation channel 16 is formed between the ridge of the keel 11 and the lamp tube 50, which cooperates with at least one heat dissipation window 17 that may be provided on the ridge of the keel 11 so as to enhance the heat dissipation effect of the lamp tube 50.

Figure 4:
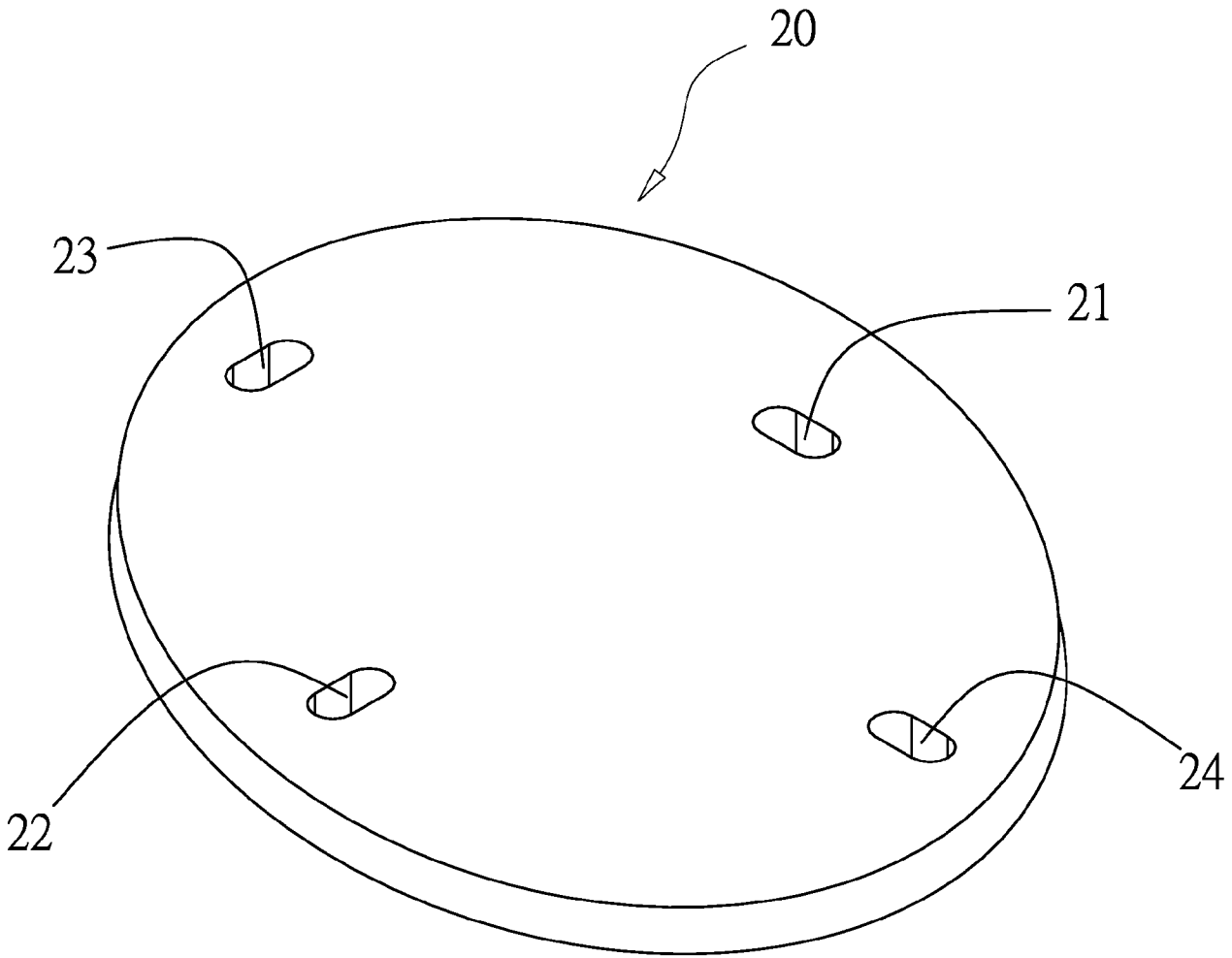
FIG. 4 is three-dimensional view of the appearance of a disk according to the present invention.
Figure 5:
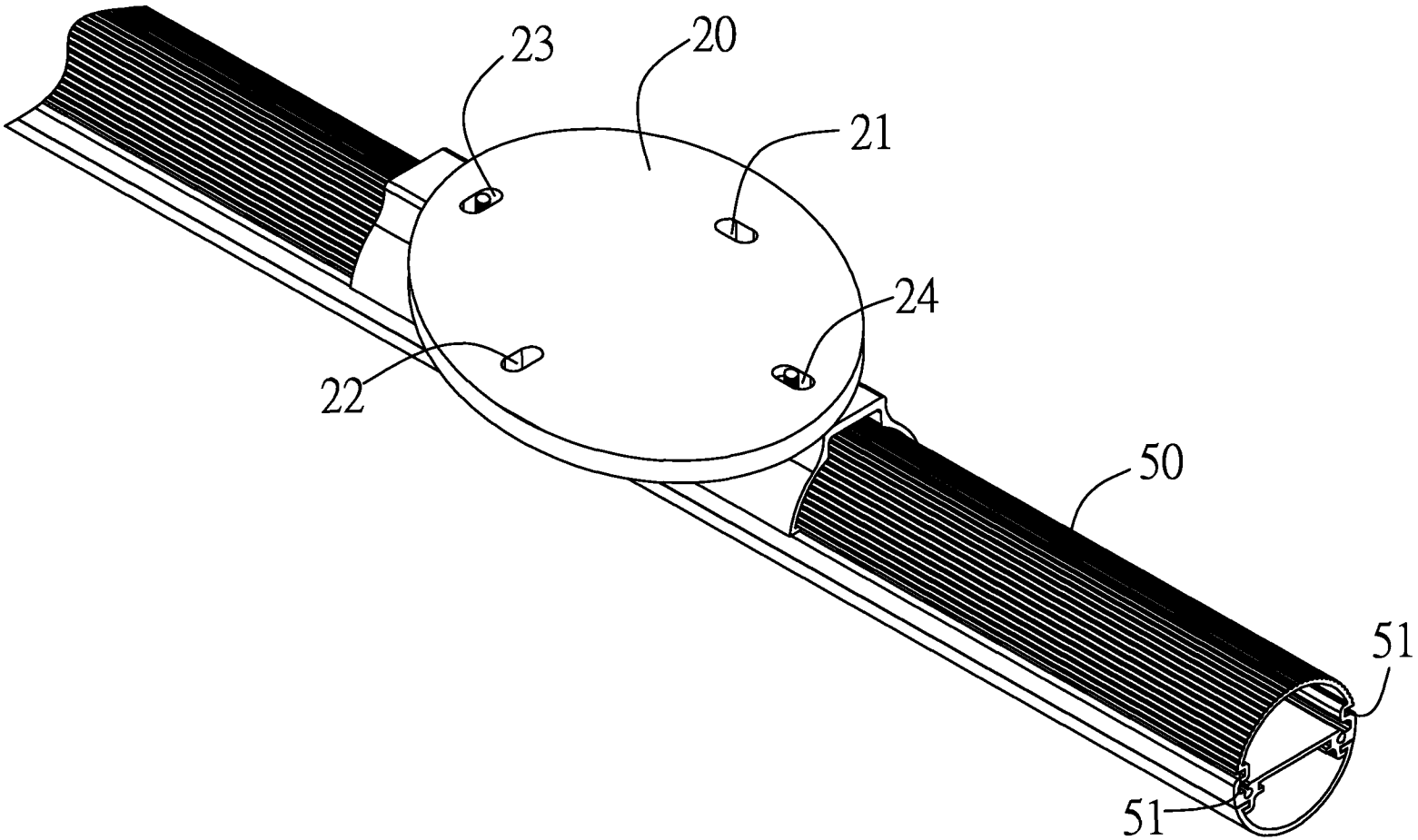
FIG. 5 is an appearance view of the assembly of a disk, a lamp support with a lamp tube according to the present invention.
Figure 6:
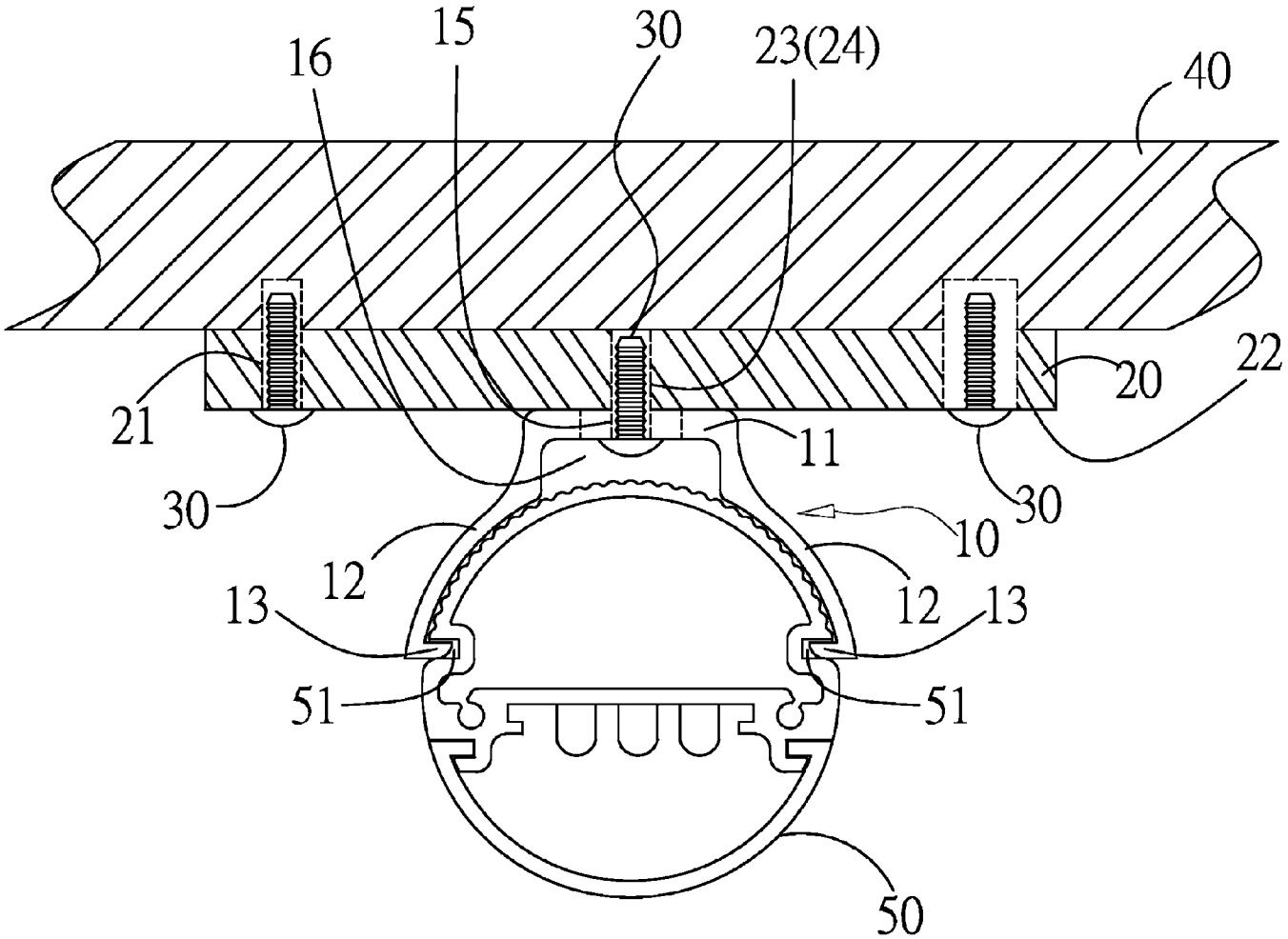
FIG. 6 is a cross-sectional view of the installation of a disk, a lamp support and a lamp tube according to the present invention.

As illustrated in FIGS. 4 through 6, a disk 20 may be further provided in the present invention, and at least third and fourth slots 21, 22 and fifth and sixth slots 23, 24 are provided on the disk 20 corresponding to the first and second slots 14, 15; wherein the third slot 21 and the fourth slot 22 are located on the same first center line and arranged perpendicular to each other; the fifth slot 23 and the sixth slot 24 are located on the same second center line and arranged perpendicular to each other, and the first and second center lines are perpendicular to each other.

Accordingly, the third and fourth slots 21, 22 (or the fifth and sixth slots 23, 24) can be optionally used to screw and secure the disk 20 to an assembly main body 40 such as a ceiling or a wall, and then the fifth and sixth slots 23, 24 (or the third and fourth slots 21, 22) are used to secure the lamp support 10 to the lower portion of the disk 20 so as to achieve the purpose of facilitating the adjustment of the assembly angle of the lamp tube.

In summarization of the foregoing description, the present invention provides an improved lamp support and disk structure, and the application for a patent is duly filed accordingly. The technical contents and features of the present invention are disclosed above. However, anyone familiar with the technique could possibly make modify or change the details in accordance with the present invention without departing from the technologic ideas and spirit of the invention. The protection scope of the present invention shall not be limited to what embodiment discloses, and should include various modification and changes that are made without departing from the technologic ideas and spirit of the present invention, and should be covered by the claims mentioned below.

What is claimed is:

1. A lamp support structure for lamp tubes, comprising:

a keel having a predetermined length as a main body, two arc-shaped extensions provided on two sides of the keel, at least one pair of inwardly protruding lips correspondingly provided on bottom edges of the arc-shaped extensions, a first slot and a second slot provided on the keel, a disk, wherein at least a pair of third and fourth slots and a pair of fifth and sixth slots are provided on the disk and arranged in respective alternative pairs to align to the first and second slots;

wherein the third slot and the fourth slot are located on a first center line;

and the fifth slot and the sixth slot are located on a second center line.

2. The lamp support structure for lamp tubes as set forth in claim 1, wherein the first slot and the second slot are arranged perpendicular to each other.

3. The lamp support structure for lamp tubes as set forth in claim 1, wherein at least one heat dissipation channel is defined adjacent the keel and the two arc-shaped extensions.

4. The lamp support structure for lamp tubes as set forth in claim 1, wherein at least one heat dissipation window is provided on the keel.

5. The lamp support structure for lamp tubes as set forth in claim 1, wherein the first center line and the second center line are perpendicular to each other.

6. The lamp support structure for lamp tubes as set forth in claim 1, wherein the third slot and the fourth slot are arranged perpendicular to each other; the fifth slot and the sixth slot are arranged perpendicular to each other.

7. The lamp support structure for lamp tubes as set forth in claim 6, wherein the first center line and the second center line are perpendicular to each other.

* * * * *